US006596679B1

(12) United States Patent
Davis et al.

(10) Patent No.: US 6,596,679 B1
(45) Date of Patent: Jul. 22, 2003

(54) BLEACHING DETERGENT COMPOSITIONS

(75) Inventors: Paul James Davis, Sharnbrook (GB); Cornelis Paul van der Logt, Vlaardingen (NL); Neil James Parry, Sharnbrook (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/625,696

(22) Filed: Jul. 26, 2000

(30) Foreign Application Priority Data

Jul. 27, 1999 (EP) ..... 99305962

(51) Int. Cl.[7] ..... C11D 1/83; C11D 3/386; C11D 3/395

(52) U.S. Cl. ..... 510/320; 510/321; 510/392; 510/393; 510/370; 510/372; 510/376; 510/530

(58) Field of Search ..... 510/320, 321, 510/392, 393, 370, 372, 376, 530

(56) References Cited

U.S. PATENT DOCUMENTS

| | | | | |
|---|---|---|---|---|
| 6,015,783 A | * | 1/2000 | von der Osten et al. | 510/392 |
| 6,133,227 A | * | 10/2000 | Barnabas et al. | 510/530 |
| 6,218,350 B1 | * | 4/2001 | Beggs et al. | 510/305 |

FOREIGN PATENT DOCUMENTS

| | | |
|---|---|---|
| DE | 196 21 224 | 11/1997 |
| EP | 194 276 | 9/1986 |
| EP | 736 544 | 10/1996 |
| GB | 2 101 167 | 1/1983 |
| WO | 94/04678 | 3/1994 |
| WO | 94/25591 | 11/1994 |
| WO | 94/29457 | 12/1994 |
| WO | 98/06812 | 2/1998 |
| WO | 98/07816 | 2/1998 |
| WO | 98/23716 | 6/1998 |
| WO | 98/56885 | 12/1998 |
| WO | 99/23221 | 5/1999 |
| WO | 99/37681 | 7/1999 |
| WO | 00/36094 | 6/2000 |

OTHER PUBLICATIONS

Kiess, M. Hect, H.J. Kalisz, H.M., "*Glucose oxidase from Penicillium amagasakiense*", European Journal of Biochemistry (1998 252 (1) 90–99.

Cavener, D.R., "*GMC Oxidoreductases*", Journal of Molecular Biology (1992) 223, 811–814.

PCT International Search Report in a PCT application PCT/EP 00/06068.

Derwent Abstract of DE 19621224—published Nov. 27, 1997.

* cited by examiner

*Primary Examiner*—Gregory Delcotto
(74) *Attorney, Agent, or Firm*—Rimma Mitelman

(57) ABSTRACT

There is provided an enzymatic detergent composition comprising a surfactant, a cofactor-dependent oxidoreductase and an antibody or antibody fragment which is directed at one or more surface amino acid residues of said oxidoreductase, characterised in that the molar ratio between said antibody or antibody fragment and said oxidoreductase is less than 1.

16 Claims, 2 Drawing Sheets

BLEACHING DETERGENT COMPOSITIONS

TECHNICAL FIELD

Figure 1:
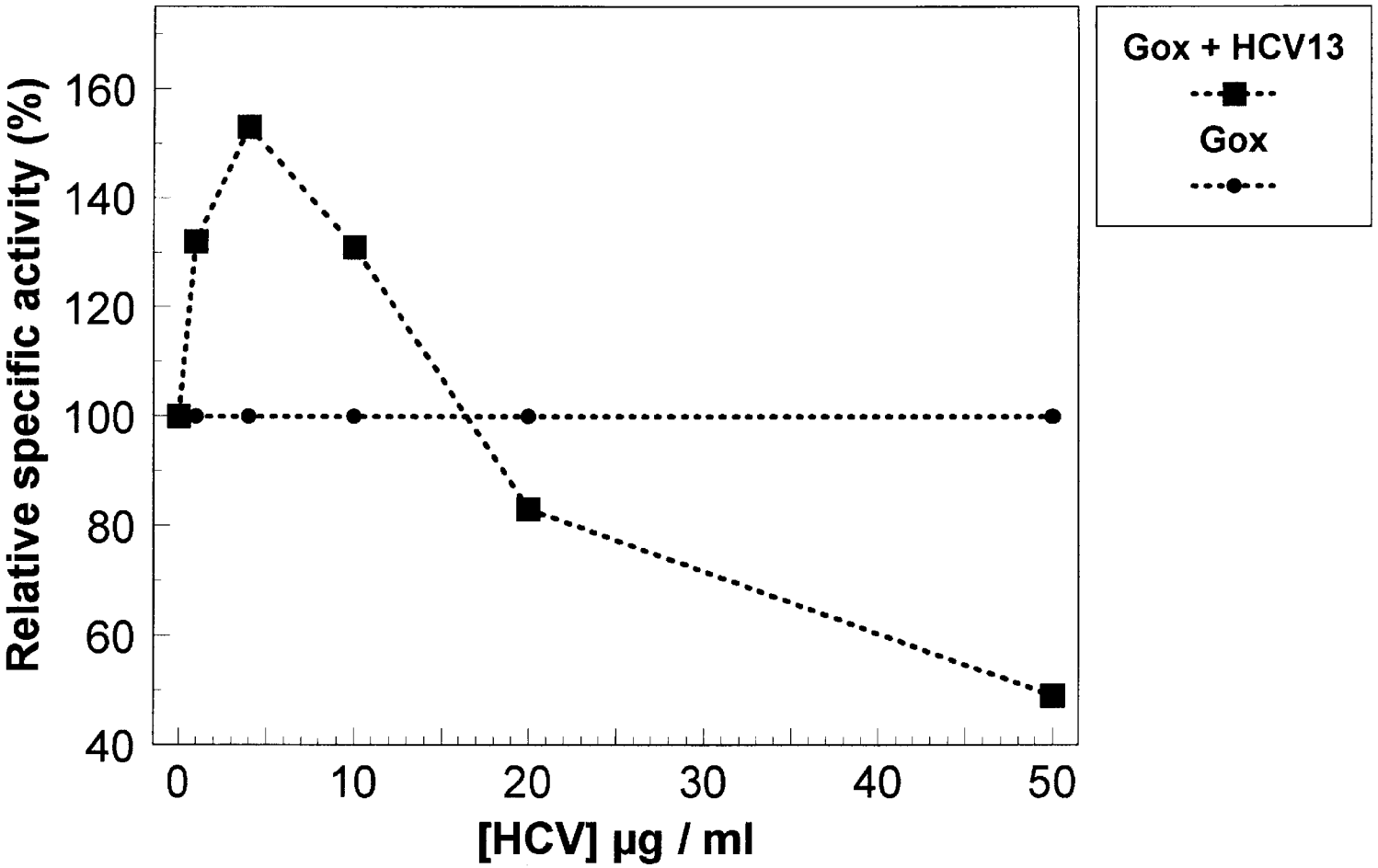

The present invention generally relates to bleaching detergent compositions. More in particular, it relates to enzymatic bleaching detergent compositions comprising a surfactant, a cofactor-dependent oxidoreductase and an antibody which is directed against said oxidoreductase. The invention also relates a process for enhancing the activity and/or stability of a cofactor-dependent oxidoreductase in detergent compositions.

BACKGROUND AND PRIOR ART

Enzymatic bleaching detergent compositions have been described in the prior art. For instance, GB-A-2 101 167 (Unilever) discloses an enzymatic bleach composition in the form of a hydrogen peroxide-generating system comprising a $C_1$–$C_4$ alkanol oxidase and a $C_1$–$C_4$ alkanol. Such enzymatic bleaching compositions may be used in detergent compositions for fabric washing, in which they may provide a low-temperature enzymatic bleach system. In the wash liquor, the alkanol oxidase enzyme catalyses the reaction between dissolved molecular oxygen and the alkanol to form an aldehyde and hydrogen peroxide. In order to obtain a significant bleach effect at low wash temperatures, e.g. at 15–55° C., the hydrogen peroxide must be activated by means of a bleach activator such tetra-acetyl ethylene diamine (TAED), which yields peracetic acid upon reacting with the hydrogen peroxide.

WO-A-98/56885 (Unilever) discloses detergent compositions comprising a bleaching enzyme capable of generating a bleaching chemical and having a high binding affinity for stains present on fabrics. It is suggested to use a bispecific agent, comprising one specificity for stains and one specificity for the bleaching enzyme. It is shown that by using a specific antibodies, one can achieve targeting of the bleaching enzyme towards the stains.

Although this and several other enzymatic bleaching detergent compositions have been proposed, there is still a need for alternative or improved enzymatic bleaching detergent compositions. In particular, there is a need for compositions having enhanced activity and/or stability of the bleaching enzyme. It will be understood that with such improved compositions, it could be possible to enzymatically bleach stains which are otherwise difficult to remove, in particular the so-called "problem stains" such as tomato, tea, blackberry juice, or red wine. Such stains normally require a significant amount of bleaching for their removal, which might negatively affect the colours of the garment.

In conventional, non-enzymatic laundry bleach systems, fabrics are everywhere exposed to the same concentration of bleach, whether "problem stains" are present or not. Repeated washing with such conventional bleach systems, which may contain relatively high concentrations of bleach, may cause damage to garments such as the fading of dyes.

It is therefore an object of the present invention to provide alternative or improved enzymatic bleaching compositions. In particular, they should provide enhanced activity and/or stability of the bleaching enzyme and they should be capable of bleaching stains which are otherwise difficult to remove, and should preferably be more selective in its bleaching action. It is a further object of the present invention to provide an alternative or improved enzymatic process for bleaching stains on fabrics.

We have now surprisingly found that it is possible to enhance the activity and/or stability of a cofactor-dependent oxidoreductase by adding antibodies directed against any surface amino acid residues of said oxidoreductase, whereby the molar ratio between said antibody and said oxidoreductase is less than 1.

The new bleaching compositions are particularly attractive for treating "problem stains" which occur only occasionally, such as fruits and vegetables. These stains are not present on most garments and when they are present they are likely to be present in different positions than habitual stains such as those found on collars and cuffs. According to the invention, it is possible to optimise the in-use concentration of the new bleaching enzyme so that threshold concentrations of bleach are only reached if stain is present and the new bleaching enzyme binds to and accumulates on said stain. When this happens, the high local concentration of enzyme generates a high local concentration of bleach near to the stain and thereby exerts a selective bleaching action where it is required. Therefore, the unstained part of the garment (typically the majority) is not exposed to high levels of bleach and thereby this fabric is protected from any bleach-associated damage. Moreover, the next time the same garment has a stain such as fruit or vegetable stains, it is likely to be in a different position on the garment. Therefore, a different position on the garment will be exposed to high levels of bleach. Therefore, problems associated with several washes in conventional bleaching systems, such as dye-fade, will be reduced or eliminated altogether. This is in stark contrast to conventional bleaching systems where all garments are uniformly exposed to high concentrations of bleach, in every wash, regardless of whether problem stains are present or not.

DEFINITION OF THE INVENTION

According to a first aspect of the invention, there is provided an enzymatic detergent composition comprising a surfactant, a cofactor-dependent oxidoreductase and an antibody which is directed against said oxidoreductase, characterised in that the molar ratio between said antibody and said oxidoreductase is less than 1.

According to a second aspect, there is provided a process for enhancing the activity or stability of an cofactor-dependent oxidoreductase, by adding an antibody which is directed against at any surface amino acid residues of said oxidoreductase, whereby the molar ratio between said antibody and said oxidoreductase is less than 1.

According to a third aspect, there is provided a process for bleaching stains present of fabrics, wherein stained fabrics are contacted with the detergent composition of the invention.

DESCRIPTION OF THE INVENTION

1. The Cofactor-dependent Oxidase

In its first aspect, the compositions of the invention comprise a cofactor-dependent oxidoreductase. Preferably, the oxidoreductase is a flavoenzyme, in which case the cofactor FAD. It is especially preferred if the enzyme belongs to the so-called glucose-methanol-choline or GMC-family of structurally related oxidoreductases. Two recent papers describing the GMC family are: (1) Kiess, M. Hecht, H. J. Kalisz, H. M. European Journal of Biochemistry (1998) 252 (1) 90–99. Glucose oxidase from Penicillium amagasakiense—Primary structure and comparison with other glucose-methanol-choline oxidoreductases and (2) Cavener, D. R., Journal of Molecular Biology (1992) 223 (3) 811–814. GMC oxidoreductases—a newly defined family of homologous proteins with diverse catalytic activities. The most preferred oxidases are glucose oxidase, galactose oxidase and alcohol oxidase.

The above mentioned hydrogen peroxide generating enzymes may be used in combination with activators which generate peracetic acid. Such activators are well-known in the art. Examples include tetraacetylethylenediamine (TAED) and sodium nonanoyl-oxybenzenesulphonate (SNOBS). These and other related compounds are described in fuller detail by Grime and Clauss in Chemistry & Industry (Oct. 15, 1990) 647–653. Alternatively, a transition metal catalyst could be used in combination with a hydrogen peroxide generating enzyme to increase the bleaching power. Examples of manganese catalysts are described by Hage et al. (1994) Nature 369, 637–639.

2. The Antibody or Antibody Fragment

As a second element, the new detergent compositions comprise an antibody or antibody fragment which is directed at the cofactor-dependent oxidoreductase. Preferably, the antibody is directed at the surface amino acids that are not involved in cofactor binding or substrate binding. Taking the residue numbering of glucose oxidase, the antibody is preferably directed at one or more of the following surface amino acid residues: 1–18, 26–28, 39–45, 50–227, 233–241, 246–248, 257–262, 273–274, 282, 288–543 or 547–560.

It is especially preferred if the antibody is directed at one or more of the following surface amino acid residues: 1–18, 26–28, 39–45, 50–115, 125–210, 214–227, 233–241, 246–248, 257–262, 273–274, 282, 288–329, 339–346, 359–361, 383–388, 405–408, 417–419, 428–543 or 547–560 of glucose oxidase.

In a preferred embodiment of the invention, the antibody or antibody fragment is a bi-functional antibody having a high binding affinity for the oxidase and for coloured or non-coloured compounds present in stains on fabrics, said coloured or non-coloured compounds having a molecular weight of at least 100, preferably at least 1,000, more preferably of at least 5,000 Daltons. It will be understood that the coloured or non-coloured compounds may also have higher molecular weights of at least 10,000, 100,000 or even 1,000,000 Daltons or more. Methods for obtaining such bi-functional antibodies or bi-heads are described in WO-A-99/23221.

The degree of binding of a molecule A to another molecule B can be generally expressed by the chemical equilibrium constant $K_d$ resulting from the following reaction:

$$[A]+[B] \Leftrightarrow [A \equiv B]$$

The chemical equilibrium constant $K_d$ is then given by:

$$K_d = \frac{[A] \times [B]}{[A \equiv B]}$$

Whether the binding of a molecule to a coloured or non-coloured compound present in stains on fabrics is specific or not can be judged from the difference between the binding ($K_d$ value) of the molecule to stained (i.e. a material treated so that stain components are bound on), versus the binding to unstained (i.e. untreated) material. For applications in laundry, said material will be a fabric such as cotton or polyester. However, it will usually be more convenient to measure $K_d$ values and differences in $K_d$ values on other materials such as a polystyrene microtitre plate or a specialised surface in an analytical biosensor. The difference between the two binding constants should be minimally 10, preferably more than 100, and more preferably, more that 1000. Typically, the compound should bind the stain, or the stained material, with a $K_d$ lower than $10^{-4}$ M, preferably lower than $10^{-6}$ M and could be $^{10-10}$ M or even less. Higher binding affinities ($K_d$ of less than $10^{-5}$ M) and/or a larger difference between the coloured or non-coloured substance and background binding would increase the selectivity of the bleaching process. Also, the weight efficiency of the molecule in the total detergent composition would be increased and smaller amounts of the molecule would be required.

Several classes of molecules can be envisaged which deliver the capability of specific binding to colored or non-coloured compounds present in stains one would like to bleach. In the following we will give a number of examples of such molecules having such capabilities, without pretending to be exhaustive.

2.1. Antibodies

Antibodies are well known examples of molecules which are capable of binding specifically to compounds against which they were raised. Antibodies can be derived from several sources. From mice, monoclonal antibodies can be obtained which possess very high binding affinities. From such antibodies, Fab, Fv or scFv fragments, can be prepared which have retained their binding properties. Such antibodies or fragments can be produced through recombinant DNA technology by microbial fermentation. Well known production hosts for antibodies and their fragments are yeast, moulds or bacteria.

A class of antibodies of particular interest is formed by the Heavy Chain antibodies as found in Camelidae, like the camel or the llama. The binding domains of these antibodies consist of a single polypeptide fragment, namely the variable region of the heavy chain polypeptide (HC-V). In contrast, in the classic antibodies (murine, human, etc.), the binding domain consist of two polypeptide chains (the variable regions of the heavy chain ($V_h$) and the light chain ($V_l$)). Procedures to obtain heavy chain immunoglobulins from Camelidae, or (functionalized) fragments thereof, have been described in WO-A-94/04678 (Casterman and Hamers) and WO-A-94/25591 (Unilever and Free University of Brussels).

Alternatively, binding domains can be obtained from the $V_h$ fragments of classical antibodies by a procedure termed "camelization". Hereby the classical $V_h$ fragment is transformed, by substitution of a number of amino acids, into a HC-V-like fragment, whereby its binding properties are retained. This procedure has been described by Riechmann et al. in a number of publications (J.Mol.Biol. (1996) 259, 957–969; Protein. Eng. (1996) 9, 531–537, Bio/Technology (1995) 13, 475–479). Also HC-V fragments can be produced through recombinant DNA technology in a number of microbial hosts (bacterial, yeast, mould), as described in WO-A-94/29457 (Unilever).

Methods for producing fusion proteins that comprise an enzyme and an antibody or that comprise an enzyme and an antibody fragment are already known in the art. One approach is described by Neuberger and Rabbits (EP-A-194 276). A method for producing a fusion protein comprising an enzyme and an antibody fragment that was derived from an antibody originating in Camelidae is described in WO-A-94/25591. A method for producing bispecific antibody fragments is described by Holliger et al. (1993) PNAS 90, 6444–6448.

A particularly attractive feature of antibody binding behaviour is their reported ability to bind to a "family" of structurally-related molecules. For example, in Gani et al. (J. Steroid Biochem.Molec.Biol. 48, 277–282) an antibody is described that was raised against progesterone but also binds to the structurally-related steroids, pregnanedione, pregnanolone and 6-hydroxy-progesterone. Therefore, using the same approach, antibodies could be isolated that bind to a whole "family" of stain chromophores (such as the polyphenols, porphyrins, or caretenoids as described below). A broad action antibody such as this could be used to treat several different stains when coupled to a bleaching enzyme.

2.2. Peptides

Peptides usually have lower binding affinities to the substances of interest than antibodies. Nevertheless, the binding properties of carefully selected or designed peptides can be sufficient to deliver the desired selectivity in a oxidation process. A peptide which is capable of binding selectively to a substance which one would like to oxidise, can for instance be obtained from a protein which is known to bind to that specific substance. An example of such a peptide would be a binding region extracted from an antibody raised against that substance. Other examples are proline-rich peptides that are known to bind to the polyphenols in wine.

Alternatively, peptides which bind to such substance can be obtained by the use of peptide combinatorial libraries. Such a library may contain up to $10^{10}$ peptides, from which the peptide with the desired binding properties can be isolated. (R. A. Houghten, Trends in Genetics, Vol 9, no &, 235–239). Several embodiments have been described for this procedure (J. Scott et al., Science (1990) 249, 386–390; Fodor et al., Science (1991) 251, 767–773; K. Lam et al., Nature (1991) 354, 82–84; R. A. Houghten et al., Nature (1991) 354, 84–86).

Suitable peptides can be produced by organic synthesis, using for example the Merrifield procedure (Merrifield (1963) J.Am.Chem.Soc. 85, 2149–2154). Alternatively, the peptides can be produced by recombinant DNA technology in microbial hosts (yeast, moulds, bacteria) (K. N. Faber et al. (1996) Appl. Microbiol. Biotechnol. 45, 72–79).

It can be readily envisaged that other molecular structures, which need not be related to proteins, peptides or derivatives thereof, can be found which bind selectively to substances one would like to oxidise with the desired binding properties. For example, certain polymeric RNA molecules which have been shown to bind small synthetic dye molecules (A. Ellington et al. (1990) Nature 346, 818–822). Such binding compounds can be obtained by the combinatorial approach, as described for peptides (L. B. McGown et al. (1995), Analytical Chemistry, 663A-668A).

This approach can also be applied for purely organic compounds which are not polymeric. Combinatorial procedures for synthesis and selection for the desired binding properties have been described for such compounds (Weber et al. (1995) Angew.Chem.Int.Ed.Engl. 34, 2280–2282; G. Lowe (1995), Chemical Society Reviews 24, 309–317; L. A. Thompson et al. (1996) Chem. Rev. 96, 550–600). Once suitable binding compounds have been identified, they can be produced on a larger scale by means of organic synthesis.

3. The Compounds Present in Stains on Fabrics

For laundry detergent applications, several classes of substances one would like to bleach can be envisaged, in particular coloured substances which may occur as stains on fabrics can be a target. It was also found to be advantageous to target the bleaching enzymes not directly to such coloured stains themselves, but rather to macromolecular compounds which themselves are not coloured but which are associated with the stains. Such macromolecular compounds have the advantage that they can have a more immunogenic nature, i.e. that it is easier to raise antibodies against them. Furthermore, they are more accessible at the surface of the stains than coloured substances, which generally have a low molecular weight. Finally, it is important to emphasise that although many stains are heterogeneous, certain non-coloured compounds are commonly present in a variety of stains.

It the context of the present invention, a non-coloured compound is defined as a compound which, in purified form in solution and after correcting for effects such as the scattering of light, has an optical density (or adsorption) for all wavelengths in the visible spectrum (i.e. from 325 nm to 900 nm) and for a light path of 1 cm at a concentration of 1 mg/ml in solution of less than 0.2 and preferably less than 0.05.

An important embodiment of the invention is to use a binding molecule (as described above) that binds to several different, but structurally-related, coloured or non-coloured molecules in a class of "stain substances". This would have the advantage of enabling a single enzyme species to bind (and bleach) several different stains. Some examples of classes of non-coloured compounds associated with stains are given below:

3.1. Pectins

Pectins are a heterogeneous group of polysaccharides which are rich in D-galacturonic acid. They are one of the most important components in the cell wall matrix of plant cells. For a review see A. Jauneau et al. (1998) Int. J. Plant Sci. 159 (1) 1–13.

3.2. Beta-lactoglobulin

Beta-lactoglobulin (BLG) is the major whey protein in the milk of various species including cows, sheep, goats, horses, and pigs. For a review see J. Godovac-Zimmermann and G. Braunitzer (1987) Milchwissenschaft 42 (5) 294–297.

Some examples of classes of coloured stain substances are given below:

3.3. Porphyrin Derived Structures

Porphyrin structures, often co-ordinated to a metal, form one class of coloured substances which occur in stains. Examples are heme or haematin in blood stain, chlorophyll as the green substance in plants, e.g. grass or spinach. Another example of a metal-free substance is bilirubin, a yellow breakdown product of heme.

3.4. Tannins, Polyphenols

Tannins are polymerised forms of certain classes of polyphenols. Such polyphenols are catechins, leuantocyanins, etc. (P. Ribéreau-Gayon, Plant Phenolics, Ed. Oliver & Boyd, Edinburgh, 1972, pp.169–198). These substances can be conjugated with simple phenols like e.g. gallic acids. These polyphenolic substances occur in tea stains, wine stains, banana stains, peach stains, etc. and are notoriously difficult to remove.

3.5. Carotenoids (G. E. Bartley et al. (1995), The Plant Cell 7, 1027–1038). Carotenoids are the coloured substances which occur in tomato (lycopene, red), mango (β-carotene, orange-yellow). They occur in food stains (tomato) which are also notoriously difficult to remove, especially on coloured fabrics, when the use of chemical bleaching agents is not advised.

3.6. Anthocyanins (P. Ribéreau-Gayon, Plant Phenolics, Ed. Oliver & Boyd, Edinburgh, 1972, 135–169). These substance are the highly coloured molecules which occur in many fruits and flowers. Typical examples, relevant for stains, are berries, but also wine. Anthocyanins have a high diversity in glycosidation patterns.

3.7. Maillard Reaction Products

Upon heating of mixtures of carbohydrate molecules in the presence of protein/peptide structures, a typical yellow/brown coloured substance arises. These substances occur for example in cooking oil and are difficult to remove from fabrics.

4. The Detergent Compositions 4.1 The Surfactants

The bleaching enzymes of the invention can be used in a laundry detergent composition which is specifically suited for stain bleaching purposes, and this constitutes a further aspect of the invention. To that extent, the composition comprises one or more surfactants and optionally other conventional detergent ingredients. The invention in its second aspect provides an enzymatic detergent composition which comprises from 0.1–50% by weight, based on the total detergent composition, of one or more surfactants. This surfactant system may in turn comprise 0–95% by weight of one or more anionic surfactants and 5–100% by weight of one or more nonionic surfactants. The surfactant system may additionally contain amphoteric or zwitterionic detergent compounds, but this in not normally desired owing to their relatively high cost. It was found to be advantageous to also include cationic surfactants into the composition. Examples of suitable cationic surfactants are given in WO-A-97/03160 and WO-A-98/17767 (Procter&Gamble).

In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$–$C_{22}$ alkyl phenol-ethylene oxide condensates, generally 5 to 25 EO, i.e. 5 to 25 units of ethylene oxide per molecule, and the condensation products of aliphatic $C_8$–$C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$–$C_{18}$ alcohols, produced for example from tallow or coconut oil, sodium and potassium alkyl $C_9$–$C_{20}$ benzene sulphonates, particularly sodium linear secondary alkyl $C_{10}$–$C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$–$C_{15}$ alkyl benzene sulphonates and sodium $C_{12}$–$C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system which is a mixture of an alkali metal salt of a $C_{16}$–$C_{18}$ primary alcohol sulphate together with a $C_{12}$–$C_{15}$ primary alcohol 3–7 EO ethoxylate.

The nonionic detergent is preferably present in amounts greater than 10%, e.g. 25–90% by weight of the surfactant system. Anionic surfactants can be present for example in amounts in the range from about 5% to about 40% by weight of the surfactant system.

The detergent composition may take any suitable physical form, such as a powder, a tablet, an aqueous or non aqueous liquid, a paste or a gel. The enzymatic bleaching detergent composition according to the invention will generally be used as a dilution in water of about 0.05 to 2%.

The bleaching enzyme used in the present invention can usefully be added to the detergent composition in any suitable form, i.e. the form of a granular composition, a liquid or a slurry of the enzyme, or with carrier material (e.g. as in EP-A-258 068 and the Savinase (TM) and Lipolase (TM) products of Novo Nordisk). A good way of adding the enzyme to a liquid detergent product is in the form of a slurry containing 0.5 to 50% by weight of the enzyme in a ethoxylated alcohol nonionic surfactant, such as described in EP-A-450 702 (Unilever).

The enzymatic bleaching compositions of the invention comprise about 0.001 to 10 milligrams of active bleaching enzyme per litre. A detergent composition will comprise about 0.001% to 1% of active enzyme (w/w).

The enzyme activity can be expressed in units. For example, in the case of glucose oxidase, one unit will oxidise 1 $\mu$mole of β-D-glucose to D-gluconolactone and $H_2O_2$ per minute at pH 6.5 at 30° C. The enzyme activity which is added to the enzymatic bleaching composition will be about 2.0 to 4,000 units per litre (of wash liquor).

4.2 Additional Enzymes

The detergent compositions of the present invention may additionally comprise one or more enzymes, which provide cleaning performance, fabric care and/or sanitation benefits.

Said enzymes include transferases, hydrolases, lyases, isomerases and ligases. Suitable members of these enzyme classes are described in Enzyme nomenclature 1992: recommendations of the Nomenclature Committee of the International Union of Biochemistry and Molecular Biology on the nomenclature and classification of enzymes, 1992, ISBN 0-12-227165-3, Academic Press. The most recent information on the nomenclature of enzymes is available on the Internet through the ExPASy WWW server (http://www.expasy.ch/)

Examples of the hydrolases are carboxylic ester hydrolase, thiolester hydrolase, phosphoric monoester hydrolase, and phosphoric diester hydrolase which act on the ester bond; glycosidase which acts on O-glycosyl compounds; glycosylase hydrolysing N-glycosyl compounds; thioether hydrolase which acts on the ether bond; and exopeptidases and endopeptidases which act on the peptide bond. Preferable among them are carboxylic ester hydrolase, glycosidase and exo- and endopeptidases. Specific examples of suitable hydrolases include (1) exopeptidases such as aminopeptidase and carboxypeptidase A and B and endopeptidases such as pepsin, pepsin B, chymosin, trypsin, chymotrypsin, elastase, enteropeptidase, cathepsin B, papain, chymopapain, ficain, thrombin, plasmin, renin, subtilisin, aspergillopepsin, collagenase, clostripain, kallikrein, gastricsin, cathepsin D, bromelain, chymotrypsin C, urokinase, cucumisin, oryzin, proteinase K, thermomycolin, thermitase, lactocepin, thermolysin, bacillolysin. Preferred among them is subtilisin; (2) glycosidases such as α-amylase, β-amylase, glucoamylase, isoamylase, cellulase, endo-1,3(4)-β-glucanase (β-glucanase), xylanase, dextranase, polygalacturonase (pectinase), lysozyme, invertase, hyaluronidase, pullulanase, neopullulanase, chitinase, arabinosidase, exocellobiohydrolase, hexosaminidase, mycodextranase, endo-1,4-β-mannanase (hemicellulase), xyloglucanase, endo-β-galactosidase (keratanase), mannanase and other saccharide gum degrading enzymes as described in WO-A-99/09127. Preferred among them are α-amylase and cellulase; (3) carboxylic ester hydrolase including carboxylesterase, lipase, phospholipase, pectinesterase, cholesterol esterase, chlorophyllase, tannase and wax-ester hydrolase. Preferred among them is lipase.

Examples of transferases and ligases are glutathione S-transferase and acid-thiol ligase as described in WO-A-98/59028 and xyloglycan endotransglycosylase as described in WO-A-98/38288.

Examples of lyases are hyaluronate lyase, pectate lyase, chondroitinase, pectin lyase, alginase II. Especially preferred is pectolyase, which is a mixture of pectinase and pectin lyase.

The activity of the oxidoreductases in a process for bleaching stains on fabrics and/or dyes in solution and/or antimicrobial treatment can also be enhanced by adding certain organic compounds, called enhancers. Examples of enhancers are 2,2'-azo-bis-(3-ethylbenzo-thiazoline-6-sulphonate (ABTS) and Phenothiazine-10-propionate (PTP). More enhancers are described in WO-A-94/12619, WO-A-94/12620, WO-A-94/12621, WO-A-97/11217, WO-A-99/23887. Enhancers are generally added at a level of 0.01% to 5% by weight of detergent composition.

A different process for enhancing the efficacy of the bleaching action of oxidoreductases is by targeting them to stains by using antibodies or antibody fragments as described in WO-A-98/56885. Antibodies can also be added to control enzyme activity as described in WO-A-98/06812.

A preferred combination is a detergent composition comprising of a mixture of conventional detergent enzymes such as protease, amylase, lipase, cutinase and/or cellulase together with one or more plant cell wall degrading enzymes.

Endopeptidases (proteolytic enzymes or proteases) of various qualities and origins and having activity in various pH ranges of from 4–12 are available and can be used in the instant invention. Examples of suitable proteolytic enzymes are the subtilisins, which can be obtained from particular strains of *B. subtilis, B. lentus, B. amyloliquefaciens* and *B. licheniformis,* such as the commercially available subtilisins Savinase™, Alcalase™, Relase™, Kannase™ and Everlase™ as supplied by Novo Industri A/S, Copenhagen, Denmark or Purafect™, PurafectOxP™ and Properase™ as supplied by Genencor International. Chemically or genetically modified variants of these enzymes are included such as described in WO-A-99/02632 pages 12 to 16 and in WO-A-99/20727 and also variants with reduced allergenicity as described in WO-A-99/00489 and WO-A-99/49056.

Suitable lipases include those of bacterial or fungal origin as described in WO-A-99/11770 pages 33, 34, such as the commercially available Lipolase™, Lipolase Ultra™, LipoPrime™ (from Novo Nordisk) or Lipomax™ (from Genencor). Chemically or genetically modified variants of these enzymes are included.

Suitable amylases include those of bacterial or fungal origin. Chemically or genetically modified variants of these enzymes are included as described in WO-A-99/02632 pages 18, 19. Commercial cellulase are sold under the tradename Purastar™, Purastar OxAm™ (formerly Purafact Ox Am™) by Genencor; Termamyl™, Fungamyl™ and Duramyl™, all available from Novo Nordisk A/S.

Suitable cellulases include those of bacterial or fungal origin. Chemically or genetically modified variants of these enzymes are included as described in WO-A-99/02632 page 17. Particularly useful cellulases are the endoglucanases such as the EGIII from *Trichoderma longibrachiatum* as described in WO-A-94/21801 and the E5 from *Thermomonospora fusca* as described in WO-A-97/20025. Endoglucanases may consist of a catalytic domain and a cellulose binding domain or a catalytic domain only. Preferred cellulolytic enzymes are sold under the tradename Carezyme™, Celluzyme™ and Endolase™ by Novo Nordisk A/S; Puradax™ is sold by Genencor and KAC™ is sold by Kao Corporation.

Detergent enzymes are usually incorporated in an amount of 0.00001% to 2%, and more preferably 0.001% to 0.5%, and even more preferably 0.01% to 0.2% in terms of pure enzyme protein by weight of the composition. Detergent enzymes are commonly employed in the form of granules made of crude enzyme alone or in combination with other components in the detergent composition. Granules of crude enzyme are used in such an amount that the pure enzyme is 0.001 to 50 weight percent in the granules. The granules are used in an amount of 0.002 to 20 and preferably 0.1 to 3 weight percent. Granular forms of detergent enzymes are known as Enzoguard™ granules, prills, marumes or T-granules. Granules can be formulated so as to contain an enzyme protecting agent (e.g. oxidation scavengers) and/or a dissolution retardant material. Other suitable forms of enzymes are liquid forms such as the "L" type liquids from Novo Nordisk, slurries of enzymes in nonionic surfactants such as the "SL" type sold by Novo Nordisk and microencapsulated enzymes marketed by Novo Nordisk under the tradename "LDP" and "CC".

The enzymes can be added as separate single ingredients (prills, granulates, stabilised liquids, etc. containing one enzyme) or as mixtures of two or more enzymes (e.g. cogranulates). Enzymes in liquid detergents can be stabilised by various techniques as for example disclosed in U.S. Pat. Nos. 4,261,868 and 4,318,818.

The detergent compositions of the present invention may additionally comprise one or more biologically active peptides such as swollenin proteins, expansins, bacteriocins and peptides capable of binding to stains.

The invention will now be further illustrated in the following, non-limiting Examples.

In the Figures is:

FIG. 1: The activation of glucose oxidase activity by bi-head binding.

Figure 2:
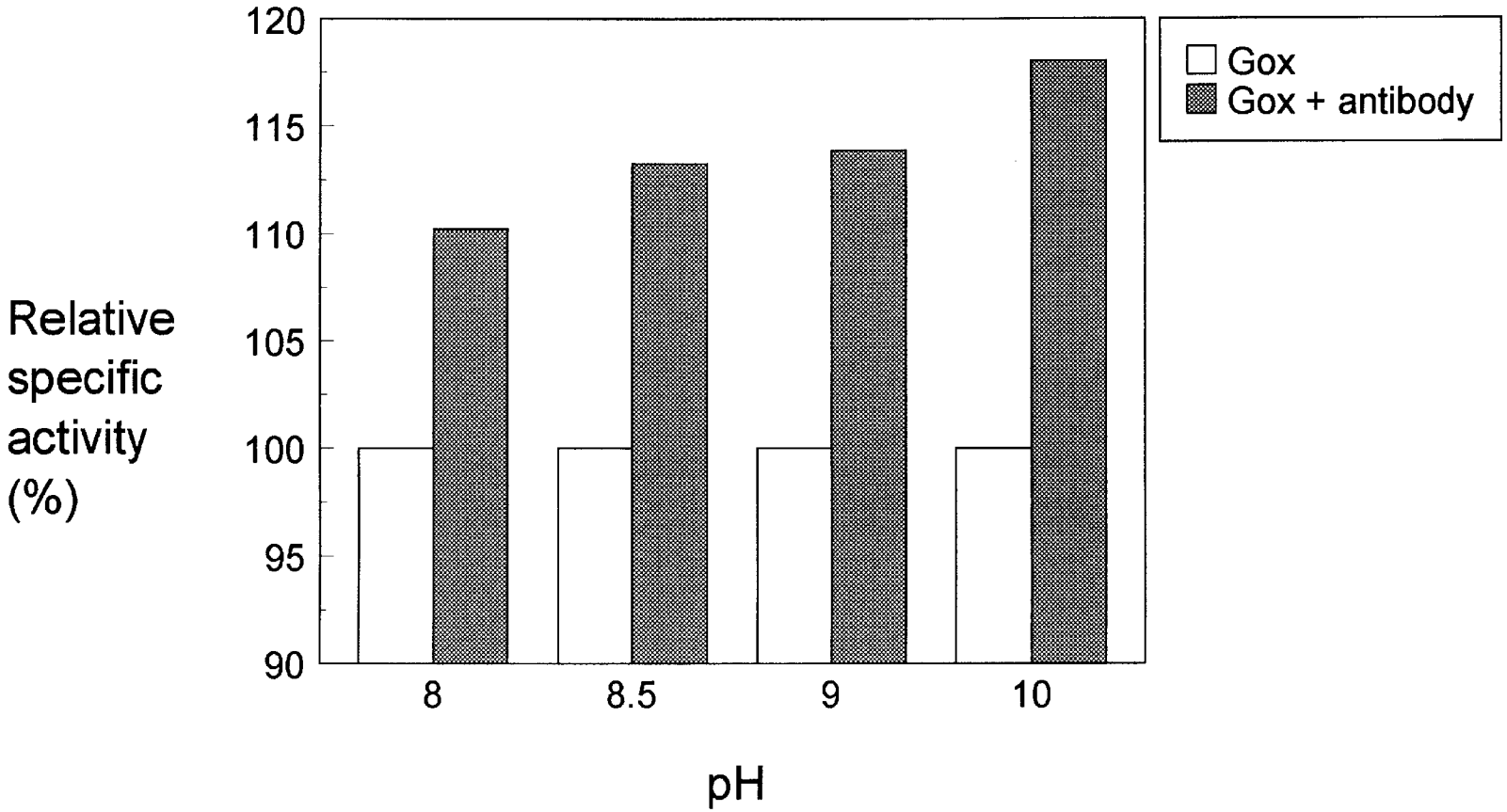

FIG. 2: The stabilizing activity of HCV antibody fragment on glucose activity as a function of pH.

EXAMPLE 1

Using the techniques described in EP-A-736 544 and WO-A-99/37681 (Unilever), an antibody (HCV) fragment was isolated and produced having a specificity for the glucose oxidase enzyme. An antibody fragment that was found to activate the glucose oxidase was named HCV13. Activation of glucose oxidase activity was assessed as follows: Reaction mixtures were prepared containing 10 μg glucose oxidase, pre-mixed in the presence of increasing amounts of HCV antibody fragment in a reaction volume of 1 ml, containing 0.1 M phosphate buffer, pH 7.2. The glucose oxidase activity was determined on the addition of D(+)glucose into the reaction mixture yielding an initial concentration of 2 mM. The concentration of glucose oxidase was 5 μg/ml. Glucose oxidase activity was followed directly by measuring the hydrogen peroxide production using a YSI 2700 Biochemistry analyser. Hydrogen peroxide production was determined using this method over a 10 minute period. All reactions were carried out at room temperature. The results are shown in FIG. 1. It is apparent from this experiment that the antibody can activate the enzymatic activity of glucose oxidase, especially when the molar ratio of antibody to glucose oxidase is less than about 1.

EXAMPLE 2

Stabilisation of Glucose Oxidase by HCV13

Reaction mixtures were prepared as in Example 1, except that the phosphate buffer was replaced by carbonate buffer at various pH values. The glucose oxidase activity was measured at each pH value and the specific activity was calculated, relative to glucose oxidase in the absence of antibody. The results are shown in FIG. 2. It is apparent that the antibody stabilizes the enzymatic activity of glucose oxidase, especially at pH values of 8 and higher.

What is claimed is:

1. Enzymatic detergent composition comprising a surfactant, a cofactor-dependent oxidoreductase, and an antibody or antibody fragment which is directed at one or more surface amino acid residues of said oxidoreductase, characterised in that the molar ratio between said antibody or antibody fragment and said oxidoreductase is less than 1.

2. Composition according to claim 1, wherein the antibody or antibody fragment is directed at the surface amino acids that are not involved in cofactor binding or substrate binding.

3. Composition according to claim 1, wherein substrates for the oxidoreductase are oxygen plus one of the following substrates: glucose, alcohol, lactate, amino acid, cholesterol.

4. Composition according to claim 1, wherein the antibody or antibody fragment is directed at one or more of the following surface amino acid residues:

1–18
26–28
39–45
50–227
233–241
246–248
257–262
273–274
282
288–543
547–560 of glucose oxidase.

5. Composition according to claim 1, wherein the antibody or antibody fragment is directed at one or more of the following surface amino acid residues:

1–18
26–28
39–45
50–115
125–210
214–227
233–241
246–248
257–262
273–274
282
288–329
339–346
359–361
383–388
405–408
417–419
428–543
547–560 of glucose oxidase.

6. Composition according to claim 1, wherein the antibody or antibody fragment is a bifunctional antibody having one functionality directed against the oxidoreductase and one functionality directed against a compound present in stains on fabrics.

7. Composition according to claim 1, wherein the oxidoreductase is selected from the group of FAD-dependant oxidoreductase.

8. Composition according to claim 1, wherein the said oxidoreductase is glucose oxidase.

9. Composition according to claim 1, wherein the antibody or antibody fragment is capable of binding to vegetable or fruit stains present on fabrics.

10. Composition according to claim 1, wherein the antibody or antibody fragment has a chemical equilibrium constant $K_d$ for the substance of less than $10^{-4}$ M.

11. Composition according to claim 1, wherein the chemical equilibrium constant $K_d$ of the antibody is less than $10^{-7}$ M.

12. Composition according to claim 1, further comprising a bleach activator.

13. Composition according to claim 12, wherein the bleach activator is a transition metal catalyst.

14. Process for enhancing the activity and/or the stability of a cofactor-dependent oxidoreductase by adding an antibody or antibody fragment which is directed against at any surface amino acid residues of said oxidoreductase, whereby the molar ratio between said antibody or antibody fragment and said oxidoreductase is less than 1.

15. Composition according to claim 1, wherein the antibody or antibody fragment has a chemical equilibrium constant $K_d$ for the substance of less than $10^{-6}$ M.

16. Composition according to claim 1, wherein the oxidoreductase is a member of the glucose-methanol-choline (GMC) oxidoreductase family.

* * * * *